US010190228B2

(12) United States Patent
Thorseth et al.

(10) Patent No.: US 10,190,228 B2
(45) Date of Patent: Jan. 29, 2019

(54) COPPER ELECTROPLATING BATHS AND ELECTROPLATING METHODS CAPABLE OF ELECTROPLATING MEGASIZED PHOTORESIST DEFINED FEATURES

(71) Applicant: Rohm and Haas Electronic Materials LLC, Marlborough, MA (US)

(72) Inventors: Matthew Thorseth, Westminster, MA (US); Rebecca Hazebrouck, Uxbridge, MA (US); Mark Scalisi, Salem, NH (US); Zuhra Niazimbetova, Westborough, MA (US); Joanna Dziewiszek, Boxborough, MA (US)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 0 days.

(21) Appl. No.: 15/451,547

(22) Filed: Mar. 7, 2017

(65) Prior Publication Data

US 2017/0283970 A1 Oct. 5, 2017

Related U.S. Application Data

(60) Provisional application No. 62/314,435, filed on Mar. 29, 2016.

(51) Int. Cl.

| | |
|---|---|
| ***C25D 3/38*** | (2006.01) |
| ***C25D 5/02*** | (2006.01) |
| ***C25D 7/12*** | (2006.01) |
| ***C25D 7/00*** | (2006.01) |

(52) U.S. Cl.

CPC ..... *C25D 5/022* (2013.01); *C25D 3/38* (2013.01); *C25D 7/00* (2013.01); *C25D 7/123* (2013.01)

(58) Field of Classification Search

None

See application file for complete search history.

(56) References Cited

U.S. PATENT DOCUMENTS

| | | | | |
|---|---|---|---|---|
| 4,356,277 | A * | 10/1982 | Birkmeyer | C08G 59/52 523/406 |
| 7,374,652 | B2 * | 5/2008 | Hayashi | C25D 3/38 205/125 |
| 2007/0007143 | A1 | 1/2007 | Hayashi et al. | |
| 2009/0139873 | A1 * | 6/2009 | Wang | C25D 3/38 205/298 |
| 2011/0011746 | A1 * | 1/2011 | Brunner | C25D 3/38 205/125 |

(Continued)

FOREIGN PATENT DOCUMENTS

| | | | |
|---|---|---|---|
| CN | 101740420 | A | 6/2010 |

OTHER PUBLICATIONS

Search report for corresponding Europe Application No. 17 16 3063 dated Jul. 24, 2017.

(Continued)

*Primary Examiner* — Stefanie S Wittenberg

(74) *Attorney, Agent, or Firm* — John J. Piskorski

(57) ABSTRACT

Copper electroplating baths and methods enable the plating of photoresist defined megafeatures at high current densities which have substantially uniform morphology and reduced nodule development. The copper electroplating baths include a mixture of heterocyclic nitrogen containing copolymers which provide megafeatures having a good % TIR and % WID balance.

8 Claims, 6 Drawing Sheets

(56) References Cited

U.S. PATENT DOCUMENTS

| | | | | |
|---|---|---|---|---|
| 2011/0220514 | A1 | 9/2011 | Niazimbetova | |
| 2012/0043654 | A1 | 2/2012 | Lu et al. | |
| 2012/0292193 | A1* | 11/2012 | Roeger-Goepfert | C08G 73/028 205/118 |
| 2012/0318676 | A1* | 12/2012 | Najjar | C25D 3/38 205/136 |
| 2014/0027298 | A1 | 1/2014 | Niazimbetova et al. | |
| 2016/0186346 | A1 | 6/2016 | Niazimbetova et al. | |
| 2017/0037528 | A1 | 2/2017 | Thorseth et al. | |

OTHER PUBLICATIONS

Search report for corresponding Taiwan Application No. 106108789 dated Mar. 13, 2018.
Search report for corresponding China Application No. 201710188677.6 dated Jul. 11, 2018.

* cited by examiner

COPPER ELECTROPLATING BATHS AND ELECTROPLATING METHODS CAPABLE OF ELECTROPLATING MEGASIZED PHOTORESIST DEFINED FEATURES

FIELD OF THE INVENTION

The present invention is directed to copper electroplating baths and electroplating methods capable of electroplating megasized photoresist defined features. More specifically, the present invention is directed to copper electroplating baths and electroplating methods capable of electroplating megasized photoresist defined features where the megasized photoresist defined features have substantially uniform surface morphology.

BACKGROUND OF THE INVENTION

Photoresist defined features include copper pillars and redistribution layer wiring such as bond pads and line space features for integrated circuit chips and printed circuit boards. The features are formed by the process of lithography where a photoresist is applied to a substrate such as a semiconductor wafer chip often referred to as a die in packaging technologies, or epoxy/glass printed circuit boards. In general, the photoresist is applied to a surface of the substrate and a mask with a pattern is applied to the photoresist. The substrate with the mask is exposed to radiation such as UV light. Typically the sections of the photoresist which are exposed to the radiation are developed away or removed exposing the surface of the substrate. Depending on the specific pattern of the mask an outline of a circuit line or via may be formed with the unexposed photoresist left on the substrate forming the walls of the circuit line pattern or vias. The surface of the substrate includes a metal seed layer or other conductive metal or metal alloy material which enables the surface of the substrate conductive. The substrate with the patterned photoresist is then immersed in a metal electroplating bath, typically a copper electroplating bath, and metal is electroplated in the circuit line pattern or vias to form features such as pillars, bond pads or circuit lines, i.e., line space features. When electroplating is complete, the remainder of the photoresist is stripped from the substrate with a stripping solution and the substrate with the photoresist defined features is further processed.

Pillars, such as copper pillars, are typically capped with solder to enable adhesion as well as electrical conduction between the semiconductor chip to which the pillars are plated and a substrate. Such arrangements are found in advanced packaging technologies. Solder capped copper pillar architectures are a fast growing segment in advanced packaging applications due to improved input/output (I/O) density compared to solder bumping alone. A copper pillar bump with the structure of a non-reflowable copper pillar and a reflowable solder cap has the following advantages: (1) copper has low electrical resistance and high current density capability; (2) thermal conductivity of copper provides more than three times the thermal conductivity of solder bumps; (3) can improve traditional BGA CTE (ball grid array coefficient of thermal expansion) mismatch problems which can cause reliability problems; and (4) copper pillars do not collapse during reflow allowing for very fine pitch without compromising stand-off height.

Of all the copper pillar bump fabrication processes, electroplating is by far the most commercially viable process. In the actual industrial production, considering the cost and process conditions, electroplating offers mass productivity and there is no polishing or corrosion process to change the surface morphology of copper pillars after the formation of the copper pillars. Therefore, it is particularly important to obtain a smooth surface morphology by electroplating. The ideal copper electroplating chemistry and method for electroplating copper pillars yields deposits with excellent uniformity, flat pillar shape and void-free intermetallic interface after reflow with solder and is able to plate at high deposition rates to enable high wafer through-out. However, development of such plating chemistry and method is a challenge for the industry as improvement in one attribute typically comes at the expense of another. This is especially true when copper pillars having relatively large diameters and heights are being plated. Such copper pillars are typically referred to as megapillars and may have heights from 50 μm up to and exceeding 200 μm. To achieve such dimensions copper pillars are electroplated from plating baths at high plating rates from 5 Amps/$dm^2$ and higher, typically from 20 Amps/$dm^2$ and higher. At such high plating rates pillars electroplated from many conventional copper electroplating baths develop nodule defects and irregular surface morphology. Such nodule defects and irregular surface morphology can compromise performance of electronic articles in which the pillars are included. Copper pillar based structures have already been employed by various manufacturers for use in consumer products such as smart phones and PCs. As Wafer Level Processing (WLP) continues to evolve and adopt the use of copper pillar technology, there will be increasing demand for copper electroplating baths and methods with advanced capabilities that can produce reliable copper megapillar structures.

Accordingly, there is a need for copper electroplating baths and methods which provide copper photoresist defined features such as copper pillars where the features have substantially uniform surface morphology and are capable of electroplating megafeatures at high electroplating rates with reduced or no nodule development.

SUMMARY OF THE INVENTION

A method include: providing a substrate comprising a layer of photoresist, wherein the layer of photoresist comprises a plurality of apertures; providing a copper electroplating bath including one or more sources of copper ions, one or more electrolytes; one or more accelerators; one or more suppressors; one or more first reaction products of a bisepoxide and an aromatic amino acid compound having a formula:

(I)

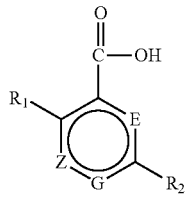

wherein $R_1$ and $R_2$ are independently chosen from hydrogen, —$NH_2$ and —OH; E is nitrogen or $CR_3$; G is nitrogen or $CR_4$ and Z is nitrogen or $CR_5$ with the proviso that only one of E, G and Z is a nitrogen at the same time and $R_3$, $R_4$ and $R_5$ are independently chosen from hydrogen, —$NH_2$ and —OH with the proviso that at least one of $R_1$, $R_2$, $R_3$, $R_4$ and $R_5$ is —$NH_2$; and one or more second reaction products of an imidazole with an epoxide; immersing the substrate comprising the layer of photoresist with the plurality of apertures in the copper electroplating bath; and electroplating a plurality of copper photoresist defined megafeatures in the plurality of apertures, the plurality of photoresist defined megafeatures comprise an average % TIR of −5% to +15%.

Copper electroplating baths include one or more sources of copper ions, one or more electrolytes, one or more accelerators, one or more suppressors, one or more first reaction products of a bisepoxide and an aromatic amino acid compound having a formula:

(I)

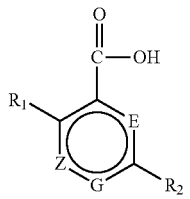

wherein $R_1$ and $R_2$ are independently chosen from hydrogen, —$NH_2$ and —OH; E is nitrogen or $CR_3$; G is nitrogen or $CR_4$ and Z is nitrogen or $CR_5$ with the proviso that only one of E, G and Z is a nitrogen at the same time and $R_3$, $R_4$ and $R_5$ are independently chosen from hydrogen, —$NH_2$ and —OH with the proviso that at least one of $R_1$, $R_2$, $R_3$, $R_4$ and $R_5$ is —$NH_2$; and one or more second reaction products of an imidazole with an epoxide in sufficient amounts to electroplate copper photoresist defined megafeatures having an average % TIR of −5% to +15%.

A plurality of photoresist defined megafeatures on a substrate comprising an average % TIR of −5% to +15% and an average % WID of 0% to 25%.

The copper electroplating methods and baths which include the combination of the two reaction products provide copper photoresist defined megafeatures which have a substantially uniform morphology and are substantially free of nodules. The copper megapillars and bond pads have a substantially flat profile. The copper electroplating baths and methods enable an average % TIR to achieve the desired morphology.

DETAILED DESCRIPTION OF THE INVENTION

Figure 1:
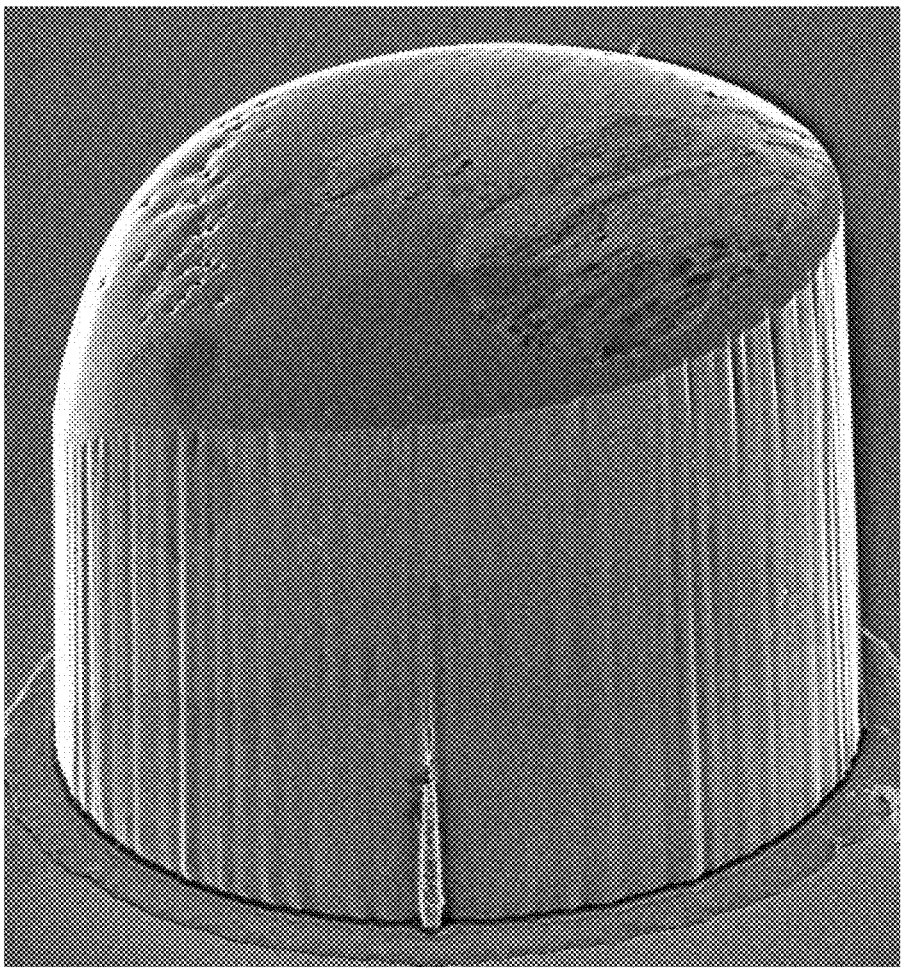
FIG. 1 is a SEM of a copper megapillar at 300× having a height of 200 μm with a smooth morphology electroplated from a copper electroplating bath of the present invention.

As used throughout this specification the following abbreviations shall have the following meanings unless the context clearly indicates otherwise: A=amperes; A/dm$^2$=amperes per square decimeter=ASD; ° C.=degrees Centigrade; UV=ultraviolet radiation; g=gram; ppm=parts per million=mg/L; L=liter, μm=micron=micrometer; mm=millimeters; cm=centimeters; DI=deionized; mL=milliliter; mol=moles; mmol=millimoles; Mw=weight average molecular weight; Mn=number average molecular weight; SEM=scanning electron microscope; FIB=focus ion beam; WID=within-die; TIR=total indicated runout=total indicator reading=full indicator movement=FIM; RDL=redistribution layer; and Avg.=average.

As used throughout this specification, the term "plating" refers to metal electroplating. "Deposition" and "plating" are used interchangeably throughout this specification. "Accelerator" refers to an organic additive that increases the plating rate of the electroplating bath. "Suppressor" refers to an organic additive that suppresses the plating rate of a metal during electroplating. The term "array" means an ordered arrangement. The term "moiety" means a part of a molecule or polymer that may include either whole functional groups or parts of functional groups as substructures. The terms "moiety" and "group" are used interchangeably throughout the specification. The term "aperture" means opening, hole, gap or via. The term "morphology" means the form, shape and structure of an article. The term "total indicator runout" or "total indicator reading" is the difference between the maximum and minimum measurements, that is, readings of an indicator, on planar, cylindrical, or contoured surface of a part, showing its amount of deviation from flatness, roundness (circularity), cylindricity, concentricity with other cylindrical features or similar conditions. The term "profilometry" means the use of a technique in the measurement and profiling of an object or the use of a laser or white light computer-generated projections to perform surface measurements of three dimensional objects. The term "pitch" means a frequency of feature positions from each other on a substrate. The term "normalizing" means a rescaling to arrive at values relative to a size variable such as a ratio as % TIR. The articles "a" and "an" refer to the singular and the plural. All numerical ranges are inclusive and combinable in any order, except where it is clear that such numerical ranges are constrained to add up to 100%.

Methods and baths for electroplating copper photoresist defined features of the present invention enable an array of photoresist defined features having an average % TIR such that the features have a morphology which is substantially smooth, free of nodules and with respect to pillars, bond pads and line space features have substantially flat profiles. The photoresist defined features of the present invention are electroplated with photoresist remaining on the substrate and extend beyond the plane of the substrate. This is in contrast to dual damascene and printed circuit board plating which typically do not use photoresist to define features which extend beyond the plane of the substrate but are inlaid into the substrate. An important difference between photoresist defined features and damascene and printed circuit board features is that with respect to the damascene and printed circuit boards the plating surface including the sidewalls are all conductive. The dual damascene and printed circuit board plating baths have a bath formulation that provides bottom-up or super-conformal filling, with the bottom of the feature plating faster than the top of the feature. In photoresist defined features, the sidewalls are non-conductive photoresist and plating only occurs at the feature bottom with the conductive seed layer and proceeds in a conformal or same plating speed everywhere deposition.

While the present invention is substantially described with respect to methods of electroplating copper megapillars having a circular morphology, the present invention also applies to other photoresist defined features such as bond pads and line space features. In general, the shapes of the features may be, for example, oblong, octagonal and rectangular in addition to circular or cylindrical. The methods of the present invention are preferably for electroplating copper cylindrical megapillars.

The copper electroplating methods provide an array of copper photoresist defined features, such as copper megapillars, with an average % TIR of −15% to +15%, preferably from −10% to +10%, more preferably from 0% to +10%.

In general, the average % TIR for an array of photoresist defined features on a substrate involves determining the % TIR of individual features from the array of features on the single substrate and averaging them. Typically, the average % TIR is determined by determining the % TIR for individual features of a region of low density or larger pitch and the % TIR for individual features of a region of high density or smaller pitch on the substrate and averaging the values. By measuring the % TIR of a variety of individual features, the average % TIR becomes representative of the whole substrate.

The % TIR may be determined by the following equation:

$$\% \text{ TIR}=[\text{height}_{center}-\text{height}_{edge}]/\text{height}_{max}\times 100$$

where $\text{height}_{center}$ is the height of a pillar as measured along its center axis and $\text{height}_{edge}$ is the height of the pillar as measured along its edge at the highest point on the edge. $\text{Height}_{max}$ is the height from the bottom of the pillar to its highest point on its top. $\text{Height}_{max}$ is a normalizing factor.

Individual feature TIRs may be determined by the following equation:

$$\text{TIR}=\text{height}_{center}-\text{height}_{edge},$$

where $\text{height}_{center}$ and $\text{height}_{edge}$ are as defined above.

In addition, the copper electroplating methods and baths may provide an array of copper photoresist defined features with a % WID of 0% to 25%, preferably from 0% to 20%. More preferably the range is 0% to 15%. The % WID or within-die may be determined by the following equation:

$$\% \text{ WID}=\tfrac{1}{2}\times[(\text{height}_{max}-\text{height}_{min})/\text{height}_{avg}]\times 100$$

where $\text{height}_{max}$ is the height of the tallest pillar of an array of pillars electroplated on a substrate as measured at the tallest part of the pillar. $\text{Height}_{min}$ is the height of the shortest pillar of an array of pillars electroplated on the substrate as measured at the tallest part of the pillar. $\text{Height}_{avg}$ is the average height of all of the pillars electroplated on the substrate.

Most preferably, the methods of the present invention provide an array of photoresist defined features on a substrate where there is a balance between the average % TIR and % WID such that the average % TIR ranges from −15% to +15% and the % WID ranges from 0% to 25% with the preferred ranges as disclosed above.

The parameters of the pillars for determining TIR, % TIR and % WID can be measured using optical profilometry such as with a white light LEICA DCM 3D or similar apparatus. Parameters such as pillar height and pitch can be measured using such devices.

In general, the copper megapillars electroplated from the copper electroplating baths can have aspect ratios of 3:1 to 1:1 or such as 2:1 to 1:1. RDL type structure can have aspect ratios as large as 1:20 (height:width).

A first reaction product of the present invention includes reacting an aromatic amino acid with a bisepoxide. Aromatic amino acids have the following formula:

(I)

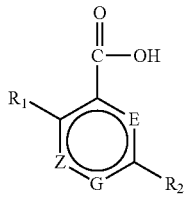

wherein $R_1$ and $R_2$ are independently chosen from hydrogen, —$NH_2$ and —OH; E is nitrogen or $CR_3$; G is nitrogen or $CR_4$ and Z is nitrogen or $CR_5$ with the proviso that only one of E, G and Z is a nitrogen at the same time and $R_3$, $R_4$ and $R_5$ are independently chosen from hydrogen, —$NH_2$ and —OH with the proviso that at least one of $R_1$, $R_2$, $R_3$, $R_4$ and $R_5$ is —$NH_2$. Preferably E is $CR_3$, G is $CR_4$ and Z is $CR_5$ where $R_1$, $R_2$, $R_3$, $R_4$ and $R_5$ are chosen from hydrogen, —$NH_2$ and —OH with the proviso that at least one of $R_1$, $R_2$, $R_3$, $R_4$ and $R_5$ is —$NH_2$. More preferably E is $CR_3$, G is $CR_4$ and Z is $CR_5$ where $R_1$, $R_2$, $R_3$, $R_4$ and $R_5$ are chosen from hydrogen and —$NH_2$ and at least one of $R_1$, $R_2$, $R_3$, $R_4$ and $R_5$ is —$NH_2$. Most preferably E is $CR_3$, G is $CR_4$ and Z is $CR_5$ where $R_1$, $R_2$, $R_3$, $R_4$ and $R_5$ are chosen from hydrogen and —$NH_2$ and only one of $R_1$, $R_2$, $R_3$, $R_4$ and $R_5$ is —$NH_2$. Examples of aromatic amino acids having formula (I) are disclosed in the table below.

TABLE 1

| Aromatic Amino Acid Structure | Aromatic Amino Acid |
|---|---|
| 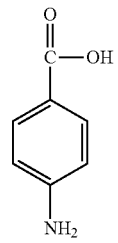 | 4-Aminobenzoic acid |
| 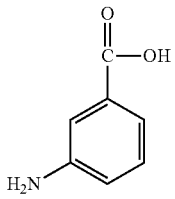 | 3-Aminobenzoic acid |
| 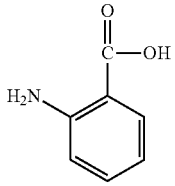 | 2-Aminobenzoic acid |

TABLE 1-continued

| Aromatic Amino Acid Structure | Aromatic Amino Acid |
|---|---|
| 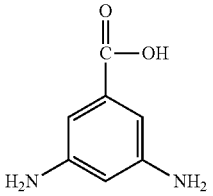 | 3,5-Diaminobenzoic acid |
| 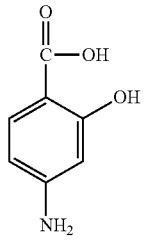 | 4-Aminosalicylic acid |
| 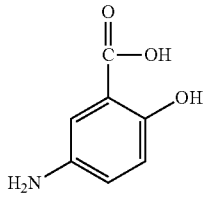 | 5-Aminosalicyclic acid |
| 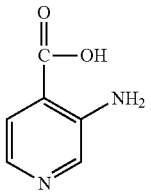 | 3-Aminoisonicotinic acid |
| 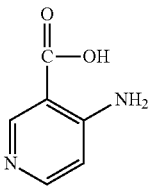 | 4-Aminonicotinic acid |
| 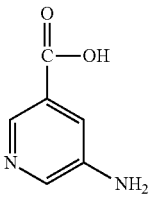 | 5-Aminonicotinic acid |
| 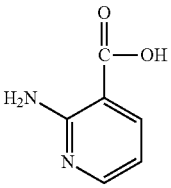 | 2-Aminonicotinic acid |

TABLE 1-continued

| Aromatic Amino Acid Structure | Aromatic Amino Acid |
|---|---|
| 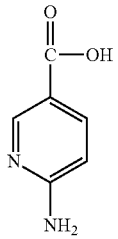 | 6-Aminonicotinic acid |
| 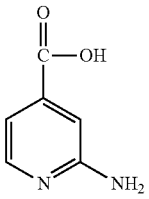 | 2-Aminoisonicotinic acid |
| 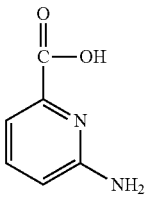 | 6-Aminopicolinic acid |

Preferably bisepoxide compounds include compounds having formula:

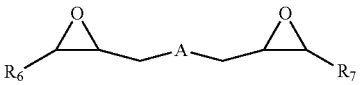

(II)

where $R_6$ and $R_7$ may be the same or different and are chosen from hydrogen and $(C_1\text{-}C_4)$alkyl, $A=O((CR_8R_9)_mO)_n$ or $(CH_2)_y$, each $R_8$ and $R_9$ is independently chosen from hydrogen, methyl, or hydroxyl, m=1-6, n=1-20 and y=0-6. $R_6$ and $R_7$ are preferably independently chosen from hydrogen and $(C_1\text{-}C_2)$alkyl. More preferably $R_6$ and $R_7$ are both hydrogen. It is preferred that m=2-4. Preferably n=1-10, more preferably n=1. Preferably y=0-4 and more preferably 1-4. When $A=(CH_2)_y$ and y=0, then A is a chemical bond.

Bisepoxides where $A=O((CR_8R_9)_mO)_n$ have a formula:

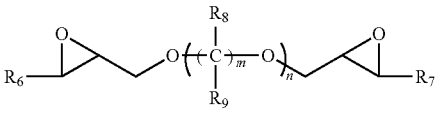

(III)

where $R_6$, $R_7$, $R_8$, $R_9$, m and n are as defined above. Preferably, $R_6$ and $R_7$ are hydrogen. Preferably $R_8$ and $R_9$ may be the same or different and are chosen from hydrogen, methyl and hydroxyl. More preferably $R_8$ is hydrogen, and $R_9$ is hydrogen or hydroxyl. Preferably m is an integer of 2-4 and n is an integer of 1-2. More preferably m is 3-4 and n is 1.

Compounds of formula (II) include, but are not limited to, 1,4-butanediol diglycidyl ether, ethylene glycol diglycidyl ether, di(ethylene glycol) diglycidyl ether, 1,2,7,8-diepoxyoctane, 1,2,5,6-diepoxyhexane, 1,2,7,8-diepoxyoctane, 1,3-butandiol diglycidyl ether, glycerol diglycidyl ether, neopentyl glycol diglycidyl ether, propylene glycol diglycidyl ether, di(propylene glycol) diglycidyl ether, poly(ethylene glycol) diglycidyl ether compounds and poly(propylene glycol) diglycidyl ether compounds.

Compounds specific for formula (III) include, but are not limited to 1,4-butanediol diglycidyl ether, ethylene glycol diglycidyl ether, di(ethylene glycol) diglycidyl ether, 1,3-butandiol diglycidyl ether, glycerol diglycidyl ether, neopentyl glycol diglycidyl ether, propylene glycol diglycidyl ether, di(propylene glycol) diglycidyl ether, poly(ethylene glycol) diglycidyl ether compounds and poly(propylene glycol) diglycidyl ether compounds.

Additional preferred bisepoxides include bisepoxides having cyclic carbon moieties such as those having six carbon cyclic moieties. Such bisepoxides include, but are not limited to 1,4-cyclohexanedimethanol diglycidyl ether and resorcinol diglycidyl ether.

The order of addition of reactants to a reaction vessel may vary, however, preferably, one or more aromatic amino acids are dissolved in water at 80° C. with dropwise addition of one or more bisepoxides. For reactants with poor water solubility small amounts of sulfuric acid or sodium hydroxide are added prior to epoxy addition. The temperature of the heating bath is then increased from 80° C. to 95° C. Heating with stirring is done for 2 hours to 4 hours. After an additional 6-12 hours of stirring at room temperature, the resulting reaction product is diluted with water. The reaction product may be used as-is in aqueous solution, may be purified or may be isolated as desired. Typically, the molar ratio of the aromatic amino acid to the bisepoxide is from 0.1:10 to 10:0.1. Preferably, the molar ratio is from 1:5 to 5:1 and more preferably from 1:2 to 2:1. Other suitable ratios of aromatic amino acid to bisepoxide may be used to prepare the present reaction products.

In general, the first reaction products have a number average molecular weight (Mn) of 2000 to 500,000, preferably from 100,000 to 400,000, although reaction products having other Mn values may be used. Such reaction products may have a weight average molecular weight (Mw) value in the range of 1000 to 750,000, preferably from 100,000 to 500,000, although other Mw values may be used.

The first reaction product of the present invention is included in copper electroplating baths in amounts of 1 ppm to 30 ppm. Preferably the first reaction product of the present invention is included in copper electroplating baths in amounts of 5 ppm to 20 ppm.

A second reaction product of the present invention includes reacting an imidazole compound with an epoxide. Imidazole compounds have the following formulae:

(IV)

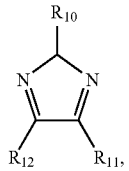

(V)

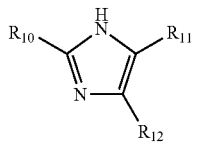

where $R_{10}$, $R_{11}$ and $R_{12}$ are independently chosen from hydrogen, linear or branched $(C_1\text{-}C_{10})$alkyl; hydroxyl; linear or branched alkoxy; linear or branched hydroxy$(C_1\text{-}C_{10})$alkyl; linear or branched alkoxy$(C_1\text{-}C_{10})$alkyl; linear or branched, carboxy$(C_1\text{-}C_{10})$alkyl; linear or branched amino $(C_1\text{-}C_{10})$alkyl; substituted or unsubstituted phenyl where the substituents may be hydroxyl, hydroxy$(C_1\text{-}C_3)$alkyl, or $(C_1\text{-}C_3)$alkyl. Preferably, $R_{10}$, $R_{11}$ and $R_{12}$ are independently chosen from hydrogen; linear or branched $(C_1\text{-}C_5)$alkyl; hydroxyl; linear or branched hydroxy$(C_1\text{-}C_5)$alkyl; and linear or branched amino$(C_1\text{-}C_5)$alkyl. More preferably $R_{10}$, $R_{11}$ and $R_{12}$ are independently chosen from hydrogen and $(C_1\text{-}C_3)$alky such as methyl, ethyl and propyl moieties. An example of a compound of formula (IV) is 2H-imidazole and examples of compounds of formula (V) are 1H-imidazole, 2-methylimidazole, 2-isopropylimidazole, 2-butyl-5-hydroxymethylimidazole, 2,5-dimethyl-1H-imidazole, 2-ethylimidazole and 4-phenylimidazole.

Epoxides which can be reacted with the imidazoles include those having the formulae of (II) and (III) above. Preferably the epoxides have the following formula:

(VI)

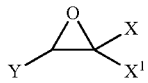

where Y is hydrogen or $(C_1\text{-}C_4)$alkyl, X is $CH_2X^2$ or $(C_2\text{-}C_6)$alkylene, $X^1$ is hydrogen or $(C_1\text{-}C_5)$alkyl and $X^2$ is halogen, $O(C_1\text{-}C_3)$alkyl or $O(C_1\text{-}C_3)$haloalkyl. Preferably Y is hydrogen. More preferably $X^1$ is hydrogen. It is preferred that X is $CH_2X^2$. It is further preferred that $X^2$ is halogen or $O(C_1\text{-}C_3)$fluoroalkyl. Even more preferred are compounds of formula (VI) where Y and $X^1$ are hydrogen, X is $CH_2X^2$ and $X^2$ is chlorine or bromine, and more preferably $X^2$ is chlorine.

Examples of epoxide compounds having formula (VI) are epihalohydrin, 1,2-epoxy-5-hexene, 2-methyl-2-vinyloxirane, and glycidyl 1,1,2,2-tetrafluoroethylether. Preferably the epoxide compound is epichlorohydrin or epibromohydrin and more preferably epichlorohydrin.

The second reaction products of the present invention can be prepared by reacting one or more imidazole compound described above with one or more epoxide compound described above. Typically a desired amount of the imidazole compounds and epoxide compounds are added to a reaction flask, followed by addition of water. The resulting mixture is heated to about 75-95° C. for 4 to 6 hours. After an additional 6-12 hours of stirring at room temperature, the resulting reaction product is diluted with water. The reaction product may be used as is in aqueous solution, can be purified or can be isolated as desired.

In general, the second reaction products have a number average molecular weight (Mn) of 500 to 10,000, although reaction products having other Mn values may be used. Such reaction products may have a weight average molecular weight (Mw) value in the range of 1000 to 50,000, preferably from 1000 to 20,000, more preferably from 5000 to 20,000.

The second reaction product of the present invention is included in copper electroplating baths in amounts of 0.25 ppm to 10 ppm. Preferably the second reaction product of the present invention is included in copper electroplating baths in amounts of 0.5 ppm to 5 ppm.

Suitable copper ion sources are copper salts and include without limitation: copper sulfate; copper halides such as copper chloride; copper acetate; copper nitrate; copper tetrafluoroborate; copper alkylsulfonates; copper aryl sulfonates; copper sulfamate; copper perchlorate and copper gluconate. Exemplary copper alkane sulfonates include copper ($C_1$-$C_6$)alkane sulfonate and more preferably copper ($C_1$-$C_3$)alkane sulfonate. Preferred copper alkane sulfonates are copper methanesulfonate, copper ethanesulfonate and copper propanesulfonate. Exemplary copper arylsulfonates include, without limitation, copper benzenesulfonate and copper p-toluenesulfonate. Mixtures of copper ion sources may be used. One or more salts of metal ions other than copper ions may be added to the present electroplating baths. Preferably, the copper salt is present in an amount sufficient to provide an amount of copper ions of 30 to 60 g/L of plating solution. More preferably the amount of copper ions is from 40 to 50 g/L.

The electrolyte useful in the present invention may be alkaline or acidic. Preferably the electrolyte is acidic. Preferably, the pH of the electrolyte is ≤2. Suitable acidic electrolytes include, but are not limited to, sulfuric acid, acetic acid, fluoroboric acid, alkanesulfonic acids such as methanesulfonic acid, ethanesulfonic acid, propanesulfonic acid and trifluoromethane sulfonic acid, aryl sulfonic acids such as benzenesulfonic acid, p-toluenesulfonic acid, sulfamic acid, hydrochloric acid, hydrobromic acid, perchloric acid, nitric acid, chromic acid and phosphoric acid. Mixtures of acids may be advantageously used in the present metal plating baths. Preferred acids include sulfuric acid, methanesulfonic acid, ethanesulfonic acid, propanesulfonic acid, hydrochloric acid and mixtures thereof. The acids may be present in an amount in the range of 1 to 400 g/L. Electrolytes are generally commercially available from a variety of sources and may be used without further purification.

Such electrolytes may optionally contain a source of halide ions. Typically chloride ions or bromide ions are used. Exemplary chloride ion sources include copper chloride, tin chloride, sodium chloride, potassium chloride and hydrochloric acid. Exemplary bromide ion sources are sodium bromide, potassium bromide and hydrogen bromide. A wide range of halide ion concentrations may be used in the present invention. Typically, the halide ion concentration is in the range of 0 to 120 ppm based on the plating bath, preferably from 50 to 80 ppm. Such halide ion sources are generally commercially available and may be used without further purification.

The plating baths typically contain an accelerator. Any accelerators (also referred to as brightening agents) are suitable for use in the present invention. Such accelerators are well-known to those skilled in the art. Accelerators include, but are not limited to, N,N-dimethyl-dithiocarbamic acid-(3-sulfopropyl)ester; 3-mercapto-propylsulfonic acid-(3-sulfopropyl)ester; 3-mercapto-propylsulfonic acid sodium salt; carbonic acid,dithio-O-ethylester-S-ester with 3-mercapto-1-propane sulfonic acid potassium salt; bis-sulfopropyl disulfide; bis-(sodium sulfopropyl)-disulfide; 3-(benzothiazolyl-S-thio)propyl sulfonic acid sodium salt; pyridinium propyl sulfobetaine; 1-sodium-3-mercaptopropane-1-sulfonate; N,N-dimethyl-dithiocarbamic acid-(3-sulfoethyl)ester; 3-mercapto-ethyl propylsulfonic acid-(3-sulfoethyl)ester; 3-mercapto-ethylsulfonic acid sodium salt; carbonic acid-dithio-O-ethylester-S-ester with 3-mercapto-1-ethane sulfonic acid potassium salt; bis-sulfoethyl disulfide; 3-(benzothiazolyl-S-thio)ethyl sulfonic acid sodium salt; pyridinium ethyl sulfobetaine; and 1-sodium-3-mercaptoethane-1-sulfonate. Accelerators may be used in a variety of amounts. In general, accelerators are used in an amount in a range of 0.1 ppm to 1000 ppm.

Suitable suppressors include, but are not limited to, polypropylene glycol copolymers and polyethylene glycol copolymers, including ethylene oxide-propylene oxide ("EO/PO") copolymers and butyl alcohol-ethylene oxide-propylene oxide copolymers. The weight average molecular weight of the suppressors may range from 800-15000, preferably 1000-15000. When such suppressors are used, they are preferably present in a range of 0.5 g/L to 15 g/L based on the weight of the composition, and more preferably from 1 g/L to 5 g/L.

The electroplating compositions may be prepared by combining the components in any order. It is preferred that the inorganic components such as source of metal ions, water, electrolyte and optional halide ion source are first added to the bath vessel, followed by the organic components such as the first reaction product, the second reaction product, accelerator, suppressor, and any other organic component. Preferably the first reaction product and the second reaction product are included in the copper electroplating baths such that the weight ratio of the first reaction product to the second reaction product is preferably from 5:1 to 40:1. More preferably the weight ratio of the first reaction product to the second reaction product is from 10:1 to 40:1.

The aqueous copper electroplating baths may optionally contain a conventional leveling agent provided such the leveling agent does not substantially compromise the morphology of the copper features. Such leveling agents may include those disclosed in U.S. Pat. No. 6,610,192 to Step et al., U.S. Pat. No. 7,128,822 to Wang et al., U.S. Pat. No. 7,374,652 to Hayashi et al. and U.S. Pat. No. 6,800,188 to Hagiwara et al. However, it is preferred that such leveling agents are excluded from the baths.

Typically, the plating baths may be used at any temperature from 10 to 65° C. or higher. Preferably, the temperature of the plating composition is from 15 to 50° C. and more preferably from 20 to 40° C.

In general, the copper electroplating baths are agitated during use. Any suitable agitation method may be used and such methods are well-known in the art. Suitable agitation methods include, but are not limited to: air sparging, work piece agitation, and impingement.

Typically, a substrate is electroplated by contacting the substrate with the plating bath. The substrate typically functions as the cathode. The plating bath contains an anode, which may be soluble or insoluble. Potential is applied to the electrodes. Current densities may range from 5 ASD to 50 ASD, preferably 20 ASD to 40 ASD, more preferably from 30 ASD to 40 ASD.

While the method of the present invention may be used to electroplate photoresist defined features such as megapillars, bonding pads and line space features, the method is described in the context of plating copper megapillars which is the preferred feature of the present invention. Copper megapillars can have a height of at least 50 μm, preferably from 100 μm to 250 μm, more preferably from 150 μm to 225 μm. Diameters can range from 10 μm to 250 μm, preferably 150 μm to 250 μm. Typically, the copper megapillars may be formed by first depositing a conductive seed layer on a substrate such as a semiconductor chip or die. The substrate is then coated with a photoresist material and imaged to selectively expose the photoresist layer to radiation such as UV radiation. The photoresist layer may be applied to a surface of the semiconductor chip by conventional processes known in the art. The thickness of the photoresist layer may vary depending on the height of the features. Typically the thickness ranges from 50 μm to 275 μm. A patterned mask is applied to a surface of the photoresist layer. The photoresist layer may be a positive or negative acting photoresist. When the photoresist is positive acting, the portions of the photoresist exposed to the radiation are removed with a developer such as an alkaline developer. A pattern of a plurality of apertures such as vias is formed on the surface which reaches all the way down to the seed layer on the substrate or die. The pitch of the pillars may range from 20 μm to 800 μm. Preferably the pitch may range from 40 μm to 500 μm. The diameters of the vias may vary depending on the diameter of the feature. The diameters of the vias may range from 10 μm to 300 μm. The entire structure may then be placed in a copper electroplating bath containing one or more of the reaction products of the present invention. Electroplating is done to fill at least a portion of each via with a copper pillar with a substantially flat top. An example of a preferred silicon wafer die with a total area of 4 $cm^2$ has an arrangement of a plurality of individual copper megapillars on the die. The rows of megapillars along the periphery of the rectangular die are a high density low pitch region with a pitch of 395 μm. The plurality of individual copper megapillars in the center region of the die is a low density high pitch region with a pitch of 800 μm. The copper megapillars in the high density region have an average % TIR of +9% and the copper megapillars in the low density region have an average % TIR of +9%. The % WID for the high density region is 17% and the % WID of the low density region is 24%.

After the megapillars are electroplated the pillars are topped with solder, either through electrodeposition, placement of solder balls, or with a solder paste. The remainder of the photoresist is removed by conventional means known in the art leaving an array of copper megapillars with solder bumps on the die. The remainder of the seed layer not covered by pillars is removed through etching processes well known in the art. The copper megapillars with the solder bumps are placed in contact with metal contacts of a substrate such as a printed circuit board, another wafer or die or an interposer which may be made of organic laminates, silicon or glass. The solder bumps are heated by conventional processes known in the art to reflow the solder and join the copper pillars to the metal contacts of the substrate. Conventional reflow processes for reflowing solder bumps may be used. An example of a reflow oven is FALCON 8500 tool from Sikiama International, Inc. which includes 5 heating and 2 cooling zones. Reflow cycles may range from 1-5. The copper megapillars are both physically and electrically contacted to the metal contacts of the substrate. An underfill material may then be injected to fill space between the die, the megapillars and the substrate. Conventional underfills which are well known in the art may be used.

Figure 2:
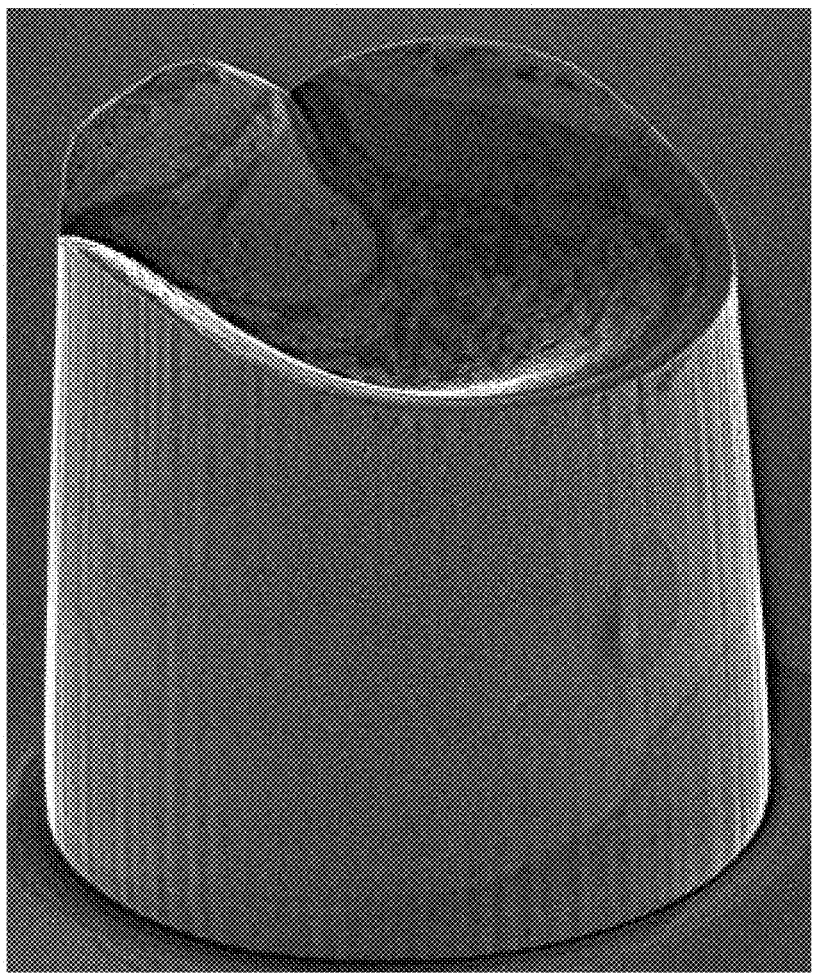
FIG. 2 is a SEM of a copper megapillar at 300× having a height of 200 μm with a severe dished top.

FIGS. 1 and 2 are SEMs of megapillars having diameters of about 200 μm. FIG. 1 is a SEM of a copper megapillar of the present invention having cylindrical morphologies with a base and substantially flat top for electroplating solder bumps. The % TIR for this pillar is 4.3%. The % WID for the array of pillars from which the pillar is taken is 17.6%. During reflow solder is melted to obtain a smooth surface. If megapillars are too domed during reflow, the solder may melt and flow off the sides of the pillar and then there is not enough solder on the top of the pillar for subsequent bonding steps. If the megapillar is too dished as shown in FIG. 2, material left from the copper bath which was used to electroplate the pillar may be retained in the dished top and contaminate the solder bath, thus shortening the life of the solder bath. The % TIR for this pillar is −15.7%. The % WID for the array of pillars from which the pillar is taken is 55.7%.

To provide a metal contact and adhesion between the copper megapillars and the semiconductor die during electroplating of the megapillars, an underbump metallization layer typically composed of a material such as titanium, titanium-tungsten or chromium is deposited on the die. Alternatively, a metal seed layer, such as a copper seed layer, may be deposited on the semiconductor die to provide metal contact between the copper megapillars and the semiconductor die. After the photosensitive layer has been removed from the die, all portions of the underbump metallization layer or seed layer are removed except for the portions underneath the megapillars. Conventional processes known in the art may be used.

The copper electroplating methods and baths which include the combination of the two reaction products provide copper photoresist defined features which have a substantially uniform morphology and are substantially free of nodules. The copper megapillars and bond pads have a substantially flat profile. The copper electroplating baths and methods enable an average % TIR to achieve the desired morphology.

The following examples are intended to further illustrate the invention but are not intended to limit its scope.

EXAMPLE 1

In 250 mL round-bottom, three-neck flask equipped with a condenser and a thermometer, 100 mmol of 2-aminobenzoic acid and 20 mL of deionized ("DI") water were added followed by addition of 100 mmol of aqueous sodium hydroxide at room temperature and 100 mmol of 1,4-butanediol diglycidyl ether at 80° C. The resulting mixture was heated for about 5 hours using an oil bath set to 95° C. and then left to stir at room temperature for additional 6 hours. The reaction product (Reaction Product 1) was transferred into a container, rinsed and adjusted with DI water. The reaction product solution was used without further purification.

EXAMPLE 2

In 100 mL round-bottom, three0neck flask equipped with a condenser and a thermometer, 100 mmol of 2H-imidazole and 20 mL of DI water were added followed by addition of 100 mmol of epichlorohydrin. The resulting mixture was heated for about 5 hours using an oil bath set to 110° C. and then left to stir at room temperature for an additional 8 hours. An amber colored not-very viscous reaction product was transferred to a 200 mL volumetric flask, rinsed and adjusted with DI water to the 200 mL mark. The reaction product (Reaction Product 2) solution was used without further purification.

EXAMPLE 3

An aqueous acid copper electroplating bath was prepared by combining 60 g/L copper ions from copper sulfate pentahydrate, 60 g/L sulfuric acid, 90 ppm chloride ion, 12 ppm of an accelerator and 2 g/L of a suppressor. The accelerator was bis(sodium-sulfopropyl)disulfide. The suppressor was an EO/PO copolymer having a weight average molecular weight of around 1,000 and terminal hydroxyl groups. The electroplating bath also contained 10 ppm of Reaction Product 1 and 3 ppm of Reaction Product 2. The pH of the bath was less than 1.

A 300 mm silicon wafer segment with a patterned photoresist 240 μm thick and a plurality of vias (available from IMAT, Inc., Vancouver, Wash.) was immersed in the copper electroplating bath. The anode was a soluble copper electrode. The wafer and the anode were connected to a rectifier and copper pillars were electroplated on the exposed seed layer at the bottom of the vias. The via diameters were 200 μm. Current density during plating was 30 ASD and the temperature of the copper electroplating bath was at 40° C. After electroplating the remaining photoresist was then stripped with BPR photostripper alkaline solution available from the Dow Chemical Company leaving an array of copper pillars on the wafer. The copper pillars were then analyzed for their morphology. The heights and TIR of the pillars were measured using an optical white light LEICA DCM 3D microscope. The % TIR was determined by the following equations:

$$\% \text{ TIR}=[\text{height}_{center}-\text{height}_{edge}]/\text{height}_{max}\times 100,$$

$$\text{TIR}=\text{height}_{center}-\text{height}_{edge}$$

The average % TIR of the eight pillars was also determined as shown in the table.

TABLE 2

| Pillar # | Via Pitch (μm) | Pillar Height$_{max}$ (μm) | Pillar TIR (μm) | % TIR |
|---|---|---|---|---|
| 1 | 400 | 156.83 | 11.59 | 7.39 |
| 2 | 400 | 128.69 | 13.18 | 10.24 |
| 3 | 400 | 119.01 | 13.78 | 11.58 |
| 4 | 400 | 124.32 | 13.27 | 10.67 |
| 5 | 400 | 135.16 | 15.76 | 11.66 |
| 6 | 1000 | 170.36 | 13.19 | 7.74 |
| 7 | 1000 | 169.82 | 21.34 | 12.57 |
| 8 | 1000 | 162.93 | 21.05 | 12.92 |
| Avg. | — | 145.89 | 15.40 | 10.60 |

The % WID for the array of pillars was determined with the optical white light LEICA DCM 3D microscope and the following equation:

$$\% \text{ WID}=\tfrac{1}{2}\times[(\text{height}_{max}-\text{height}_{min})/\text{height}_{avg}]\times 100$$

The average % WID was 17.6% and the average % TIR was 10.6. The surface of the pillars all appeared smooth and free of nodules. The copper electroplating baths which included the combination of the reaction products of Examples 1 and 2 plated good copper megapillars. FIG. 1 is a 300× AMRAY SEM image of one of the pillars plated on a seed layer and analyzed with the optical microscope. The surface morphology was smooth. The % TIR for this particular pillar was 4.3%.

EXAMPLE 4

The method of Example 3 was repeated except that the amount of Reaction Product 1 added to the copper electroplating bath was 7.5 ppm. The amount of Reaction 2 was the same, 2 ppm.

Table 3 below shows the results of the copper electroplating of the megapillars.

TABLE 3

| Pillar # | Via Pitch (μm) | Pillar Height$_{max}$ (μm) | Pillar TIR (μm) | % TIR |
|---|---|---|---|---|
| 1 | 400 | 166.01 | 13.34 | 8.04 |
| 2 | 400 | 128.77 | 13.33 | 10.35 |
| 3 | 400 | 120.02 | 12.14 | 10.11 |
| 4 | 400 | 121.87 | 12.18 | 9.99 |
| 5 | 400 | 136.53 | 9.41 | 6.89 |
| 6 | 1000 | 168.56 | 11.15 | 6.61 |
| 7 | 1000 | 167.17 | 17.24 | 10.31 |
| 8 | 1000 | 162.12 | 16.43 | 10.13 |
| Avg. | — | 146.38 | 13.15 | 9.06 |

The average % TIR and % WID were determined by the same process as in Example 3. The average % TIR was 9.06 and the % WID was 16.6%.

Figure 3:
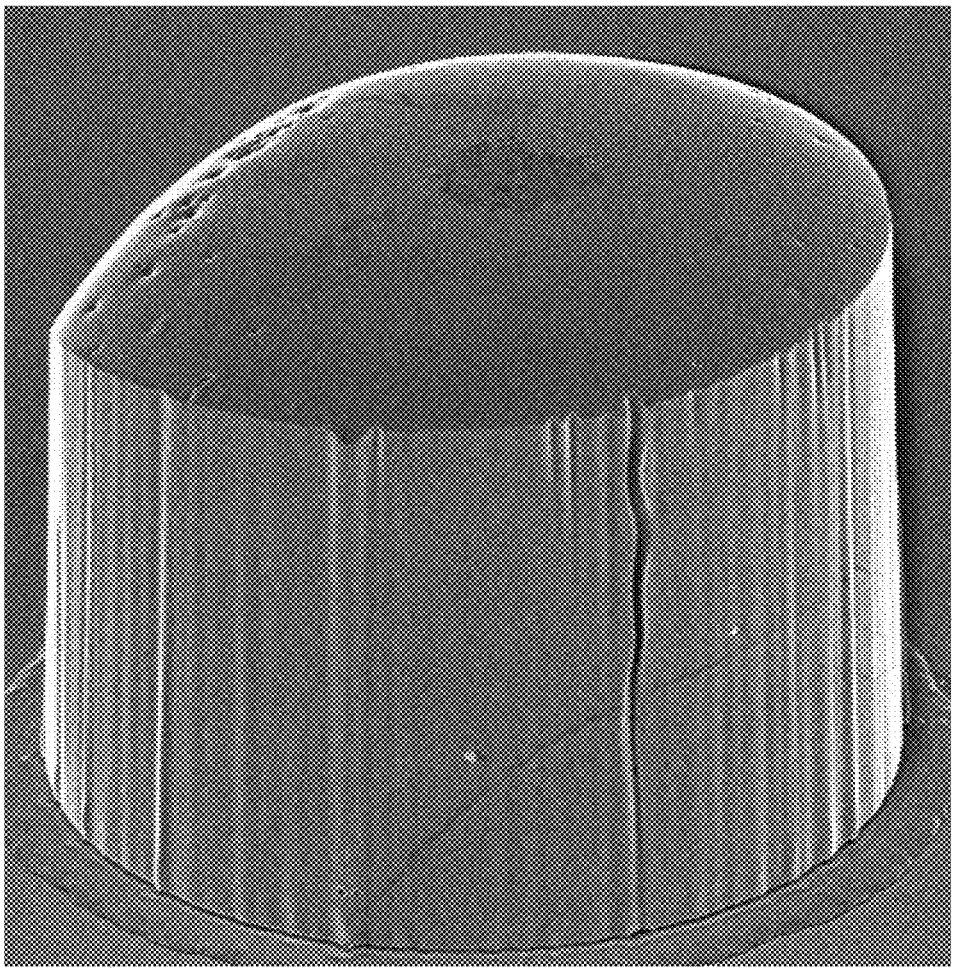
FIG. 3 is a SEM of a copper megapillar at 300× having a height of 200 μm with a smooth morphology electroplated from a copper electroplating bath of the present invention.

The surface of the pillars all appeared smooth and free of nodules. The copper electroplating baths which included the combination of the reaction products of Examples 1 and 2 plated good copper megapillars. FIG. 3 is a 300× AMRAY SEM image of one of the pillars plated on a seed layer and analyzed with the optical microscope. The surface morphology was smooth.

EXAMPLE 5 (Comparative)

The method described in Example 3 was repeated except that the copper electroplating bath included Reaction Product 1 at a concentration of 10 ppm but Reaction Product 2 was not added to the bath. The results of copper megapillar electroplating are in Table 4.

TABLE 4

| Pillar # | Via Pitch (μm) | Pillar Height$_{max}$ (μm) | Pillar TIR (μm) | % TIR |
|---|---|---|---|---|
| 1 | 400 | 199.52 | 13.72 | 6.88 |
| 2 | 400 | 134.11 | 15 | 11.78 |
| 3 | 400 | 120.79 | 14.36 | 11.89 |
| 4 | 400 | 122.41 | 11.48 | 9.38 |
| 5 | 400 | 155.04 | 18.72 | 11.49 |
| 6 | 1000 | 241.64 | 18.65 | 7.72 |
| 7 | 1000 | 238.6 | 15.62 | 6.55 |
| 8 | 1000 | 221.52 | 9.95 | 4.49 |
| Avg. | — | 179.20 | 14.67 | 8.77 |

The average % TIR and % WID were determined by the same process as in Example 3. The average % TIR was 8.77% and the % WID was 433.7%.

Figure 4:
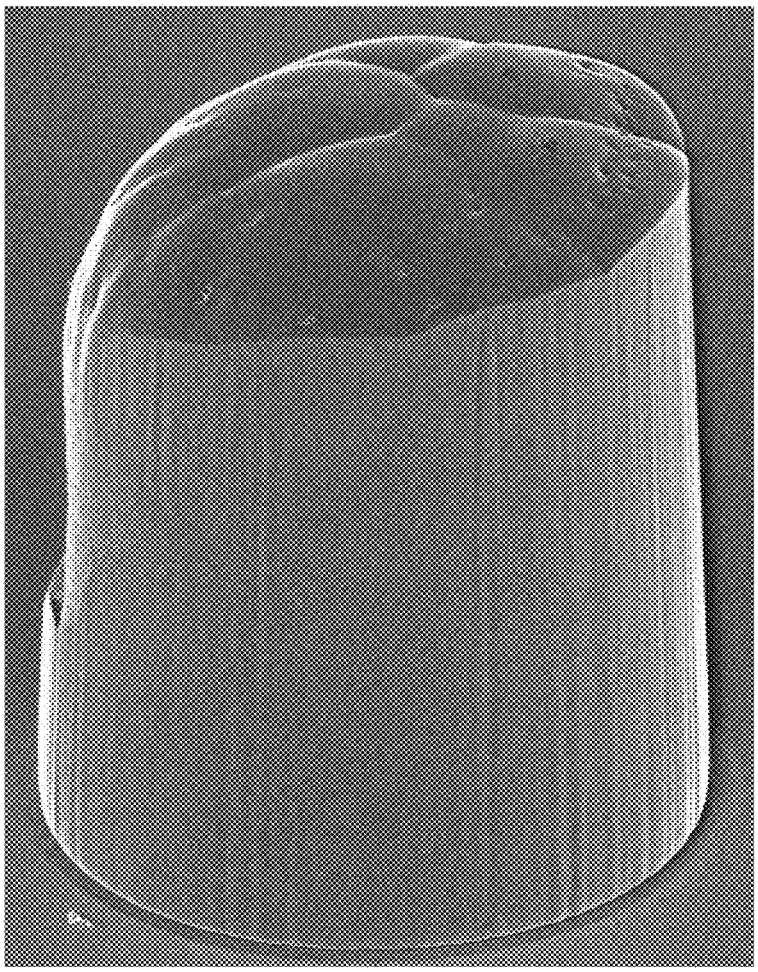
FIG. 4 is a SEM of a copper megapillar at 300× having a height of 200 μm with severe bumping on its top.

FIG. 4 is a 300× AMRAY SEM image of one of the pillars plated and analyzed with the optical microscope. Substantially all of the megapillars observed on the wafer had the same morphology. Although the sides of the megapillar were smooth, the top was irregular with bumps and unsuitable for solder application.

EXAMPLE 6 (Comparative)

The method described in Example 3 was repeated except that the copper electroplating bath included Reaction Product 1 at a concentration of 20 ppm but Reaction Product 2 was not added to the bath. The results of copper megapillar electroplating are in Table 5.

TABLE 5

| Pillar # | Via Pitch (μm) | Pillar Height$_{max}$ (μm) | Pillar TIR (μm) | % TIR |
|---|---|---|---|---|
| 1 | 400 | 200.6 | 14.12 | 7.04 |
| 2 | 400 | 135.1 | 15.56 | 11.52 |
| 3 | 400 | 134.4 | 26.12 | 19.45 |
| 4 | 400 | 139.1 | 37.39 | 26.88 |
| 5 | 400 | 153.1 | 24.04 | 15.71 |
| 6 | 1000 | 245.0 | 15.58 | 6.36 |
| 7 | 1000 | 243.1 | 13.58 | 5.59 |
| 8 | 1000 | 226.4 | 15.01 | 6.63 |
| Avg. | — | 184.6 | 20.18 | 12.40 |

The average % TIR and % WID were determined by the same process as in Example 3. The average % TIR was 12.4 and the % WID was 30%. The % WID was exceeded the target value of 25% or less.

Figure 5:
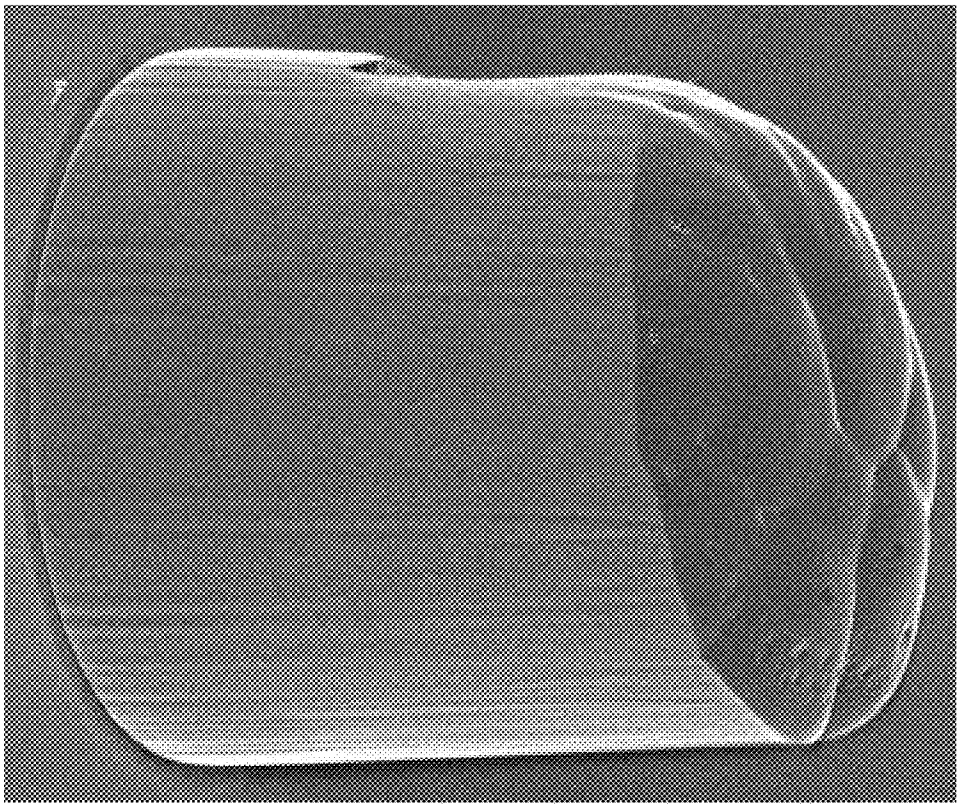
FIG. 5 is a SEM of a copper megapillar at 300× having a height of 200 μm with severe bumping on its top.

FIG. 5 is a 300× AMRAY SEM image of one of the pillars plated and analyzed with the optical microscope. Substantially all of the megapillars observed on the wafer had the same morphology. Although the sides of the megapillar were smooth, the top was irregular as the megapillar in Example 5 above with bumps and unsuitable for solder application.

EXAMPLE 7 (Comparative)

An aqueous acid copper electroplating bath was prepared by combining 60 g/L copper ions from copper sulfate pentahydrate, 60 g/L sulfuric acid, 90 ppm chloride ion, 12 ppm of an accelerator and 2 g/L of a suppressor. The accelerator was bis(sodium-sulfopropyl)disulfide. The suppressor was an EO/PO copolymer having a weight average molecular weight of around 1,000 and terminal hydroxyl groups. The electroplating bath also contained 1 ppm of Reaction Product 2. The pH of the bath was less than 1.

Figure 6:
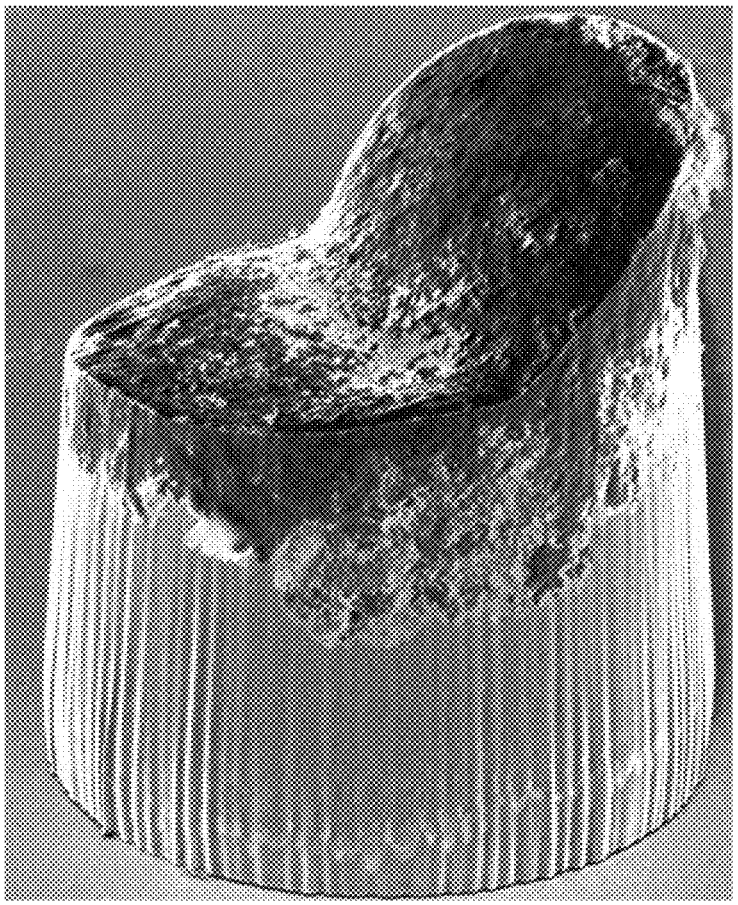
FIG. 6 is a SEM of a copper pillar at 300× having a severe chair-like configuration on its top.

A 300 mm silicon wafer segment with a patterned photoresist 205 μm thick and a plurality of vias (available from IMAT, Inc., Vancouver, Wash.) was immersed in the copper electroplating bath. The anode was a soluble copper electrode. The wafer and the anode were connected to a rectifier and copper pillars were electroplated on the exposed seed layer at the bottom of the vias. The via diameters were 100 μm. Current density during plating was 20 ASD and the temperature of the copper electroplating bath was at 40° C. After electroplating the remaining photoresist was then stripped with BPR photostripper alkaline solution available from the Dow Chemical Company leaving an array of copper pillars on the wafer. The copper pillars were then analyzed for their morphology. FIG. 6 is a representative example of the copper pillars plated. Substantially all of the pillars had severe dishing and rough surface appearance. Neither the % TIR not the % WID was determined due to the poor quality of the pillar morphology.

What is claimed is:

1. A method comprising:

a) providing a substrate comprising a layer of photoresist, wherein the layer of photoresist comprises a plurality of apertures;

b) providing a copper electroplating bath comprising one or more sources of copper ions, one or more electrolytes, wherein the electrolytes comprise an acid or a mixture of acids and, optionally, a source of halide ions; one or more accelerators; one or more suppressors; one or more first reaction products consisting of a bisepoxide and an aromatic amino acid compound having a formula:

(I)

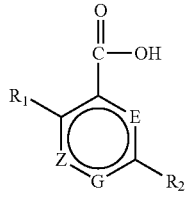

wherein $R_1$ and $R_2$ are independently chosen from hydrogen, —$NH_2$ and —OH; E is nitrogen or $CR_3$; G is nitrogen or $CR_4$ and Z is nitrogen or $CR_5$ with the proviso that only one of E, G and Z is a nitrogen at the same time and $R_3$, $R_4$ and $R_5$ are independently chosen from hydrogen, —$NH_2$ and —OH with the proviso that at least one of $R_1$, $R_2$, $R_3$, $R_4$ and $R_5$ is —$NH_2$; and one or more second reaction products consisting of an imidazole with an epoxide;

c) immersing the substrate comprising the layer of photoresist with the plurality of apertures in the copper electroplating bath; and d) electroplating a plurality of copper photoresist defined megapillars in the plurality of apertures, wherein the megapillars have aspect ratios of 3:1 to 1:1, and the plurality of copper photoresist defined megapillars comprise an average % TIR of −5% to +15%.

2. The method of claim 1, wherein the bisepoxide has a formula:

(II)

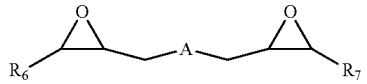

wherein $R_6$ and $R_7$ are independently chosen from hydrogen and $(C_1\text{-}C_4)$alkyl, $A{=}O((CR_8R_9)_mO)_n$, $(CH_2)_y$, or a chemical bond, each $R_8$ and $R_9$ is independently chosen from hydrogen, methyl, or hydroxyl, m=1-6, n=1-20 and y=0-6 and when y=0, A is the chemical bond.

3. The method of claim 2, wherein the bisepoxide has a formula:

(III)

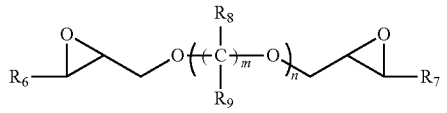

wherein $R_6$ and $R_7$ are independently chosen from hydrogen and $(C_1\text{-}C_4)$alkyl, $R_8$ and $R_9$ are chosen from hydrogen, methyl or hydroxyl, m=1-6 and n=1.

4. The method of claim 1, wherein the imidazole has a formula:

(IV)

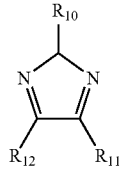

wherein $R_{10}$, $R_{11}$ and $R_{12}$ are independently chosen from hydrogen, linear or branched $(C_1\text{-}C_{10})$alkyl, hydroxyl, linear or branched alkoxy, linear or branched ydroxyl $(C_1\text{-}C_{10})$alkyl, linear or branched alkoxy$(C_1\text{-}C_{10})$alkyl, linear or branched, carboxy$(C_1\text{-}C_{10})$alkyl, linear or branched amino$(C_1\text{-}C_{10})$alkyl, substituted or unsubstituted phenyl where the substituents are chosen from hydroxyl, ydroxyl$(C_1\text{-}C_3)$alkyl, and $(C_1\text{-}C_3)$alkyl.

5. The method of claim 1, wherein the epoxide has a formula:

(VI)

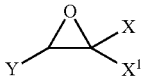

wherein Y is hydrogen or $(C_1\text{-}C_4)$alkyl, X is $CH_2X^2$ or $(C_2\text{-}C_6)$alkylene, $X^1$ is hydrogen or $(C_1\text{-}C_5)$alkyl and $X^2$ is halogen, $O(C_1\text{-}C_3)$alkyl or $O(C_1\text{-}C_3)$haloalkyl.

6. The method of claim 1, wherein a weight ratio of the one or more first reaction products to the second reaction products 5:1 to 40:1 in the copper electroplating bath.

7. The method of claim 1, wherein electroplating is performed at a current density of 5 ASD to 50 ASD.

8. The method of claim 1, wherein the plurality of the copper photoresist defined megapillars have a height of at least 50 μm.

* * * * *